US008681196B2

(12) United States Patent
Sugizaki

(10) Patent No.: US 8,681,196 B2
(45) Date of Patent: Mar. 25, 2014

(54) SCANNING EXPOSURE DEVICE AND IMAGE-FORMING APPARATUS

(75) Inventor: Tadashi Sugizaki, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 137 days.

(21) Appl. No.: 12/846,033

(22) Filed: Jul. 29, 2010

(65) Prior Publication Data

US 2011/0063591 A1 Mar. 17, 2011

(30) Foreign Application Priority Data

Sep. 15, 2009 (JP) ..... 2009-213588

(51) Int. Cl.
*B41J 2/385* (2006.01)
*B41J 2/41* (2006.01)
*B41J 2/435* (2006.01)

(52) U.S. Cl.
USPC ..... 347/245; 347/138; 347/152; 347/263

(58) Field of Classification Search
None
See application file for complete search history.

(56) References Cited

U.S. PATENT DOCUMENTS

| | | | | |
|---|---|---|---|---|
| 7,252,446 | B2 | 8/2007 | Katayama et al. | |
| 7,312,808 | B2 | 12/2007 | Kato et al. | |
| 7,319,476 | B2 | 1/2008 | Kato et al. | |
| 7,410,313 | B2 | 8/2008 | Katayama et al. | |
| 7,515,865 | B2 | 4/2009 | Matsushima et al. | |
| 7,526,226 | B2 | 4/2009 | Ito et al. | |
| 7,532,839 | B2 | 5/2009 | Ishii | |
| 7,720,409 | B2 | 5/2010 | Ito et al. | |
| 8,417,177 | B2 | 4/2013 | Ito et al. | |
| 2006/0285170 | A1 * | 12/2006 | Mamiya | 358/305 |
| 2007/0216966 | A1 * | 9/2007 | Ohsugi | 358/484 |

FOREIGN PATENT DOCUMENTS

| | | | |
|---|---|---|---|
| CN | 100421033 | C | 9/2008 |
| JP | A-2002-148543 | | 5/2002 |
| JP | A-2004-54019 | | 2/2004 |
| JP | A-2005-156781 | | 6/2005 |
| JP | 2006150687 | A * | 6/2006 |
| JP | A-2006-150687 | | 6/2006 |
| JP | A-2007-203708 | | 8/2007 |
| JP | A-2008-064987 | | 3/2008 |

OTHER PUBLICATIONS

Sep. 18, 2012 Office Action issued in Japanese Patent Application No. 2009-213588 (with English Translation).
First Notification of Office Action dated Dec. 5, 2013 from Chinese Patent Application No. 201010282819.3 (with English-language translation).

* cited by examiner

*Primary Examiner* — Matthew Luu
*Assistant Examiner* — Kendrick Liu
(74) *Attorney, Agent, or Firm* — Oliff PLC

(57) ABSTRACT

A scanning exposure device includes: a reflecting member that reflects a light irradiated by an irradiating unit; a housing that has a bottom, a first sidewall, a second sidewall, and an aperture opening in a direction of a light reflected by the reflecting member; a cover that covers the aperture, forms a passing portion that allows the light reflected by the reflecting member to pass through, and provides a first fixed position at which the housing is fixed on the first sidewall and a second fixed position, paired with the first fixed position, at which the housing is fixed on the second sidewall, wherein the first fixed position and the second fixed position are arranged such that the main scanning direction passes between them.

19 Claims, 7 Drawing Sheets

SCANNING EXPOSURE DEVICE AND IMAGE-FORMING APPARATUS

CROSS-REFERENCE TO RELATED APPLICATIONS

This application is based on and claims priority under 35 USC 119 from Japanese Patent Application No. 2009-213588 filed on Sep. 15, 2009.

BACKGROUND

1. Technical Field

The present invention relates to a scanning exposure device and an image-forming apparatus.

2. Related Art

A scanning exposure device of an image-forming apparatus may have a housing, and a cover fixed to the housing. Such a housing and cover may expand and be deformed due to heat.

SUMMARY

According to an aspect of the invention, there is provided a scanning exposure device including: a reflecting member that has a width extending from a first end to a second end in a main scanning direction, to reflect a light irradiated by an irradiating unit; a housing that has a bottom, a first sidewall to which the first end is fixed, a second sidewall facing the first sidewall, to which the second end is fixed, and an aperture provided in an opposing relation to the bottom, the aperture opening in a direction of a light reflected by the reflecting member; a cover that covers the aperture, the cover forming a passing portion that allows the light reflected by the reflecting member to pass through, and providing a first fixed position at which the cover is fixed on the first sidewall and a second fixed position, paired with the first fixed position, at which the cover is fixed on the second sidewall, wherein the first fixed position and the second fixed position are arranged such that the main scanning direction passes between them.

BRIEF DESCRIPTION OF THE DRAWINGS

Exemplary embodiments of the present invention will now be described in detail based on the following figures, wherein.

DETAILED DESCRIPTION

Figure 1:
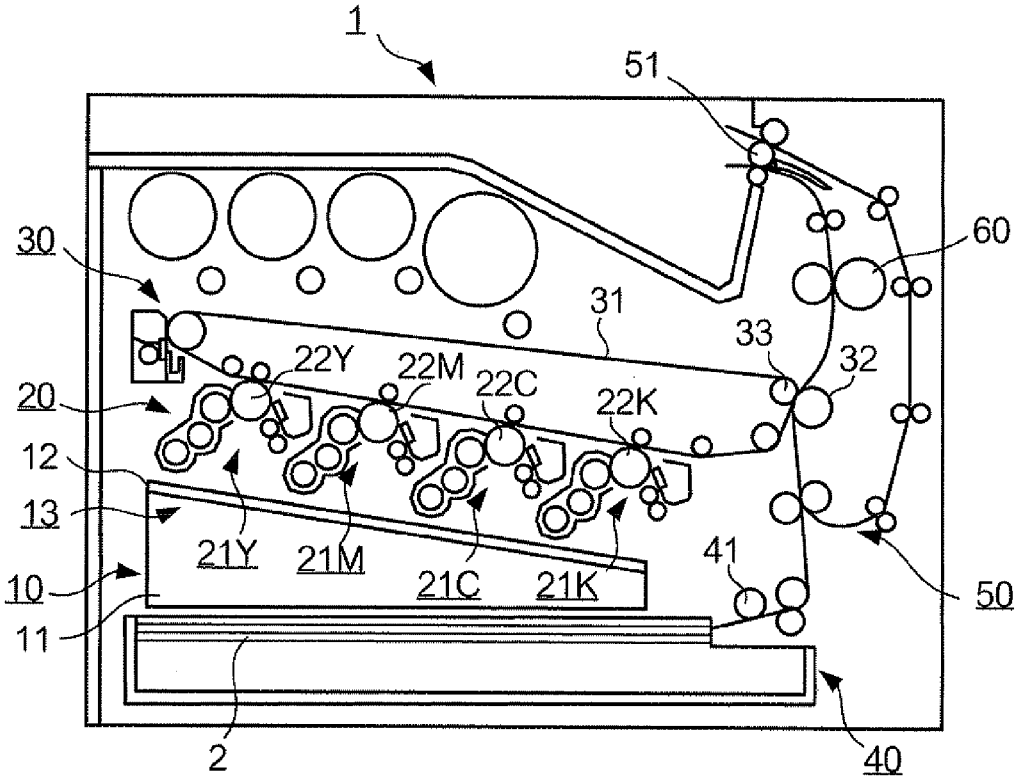
FIG. 1 is a schematic diagram of an image-forming apparatus according to an exemplary embodiment.

FIG. 1 is a schematic diagram of an image-forming apparatus according to an exemplary embodiment of the present invention. Image-forming apparatus 1 includes scanning exposure device 10, developing device 20, transfer unit 30, stacker 40, transporting unit 50, and fixing unit 60. In the exemplary embodiment, scanning exposure device 10, developing device 20, transfer unit 30, stacker 40, transporting unit 50, and fixing unit 60 cooperate with each other and function as an image-forming unit according to the present invention. Developing device 20 includes developing units 21Y, 21M, 21C, and 21K. Developing units 21Y, 21M, 21C, and 21K form toner images of corresponding colors, yellow (Y), magenta (M), cyan (C), and black (K), respectively. Developing units 21Y, 21M, 21C, and 21K are arranged such that developing unit 21Y is located at the highest position, and developing unit 21K is located at the lowest position. In other words, developing unit 21Y is located at a relatively higher position than developing unit 21K. Developing units 21Y, 21M, 21C, and 21K respectively include photosensitive drums 22Y, 22M, 22C, and 22K (hereinafter each of which is referred to as photosensitive drum 22 when no distinction need be made between these photosensitive drums). Photosensitive drums 22 are exposed by scanning exposure device 10 in response to an image signal.

For convenience of explanation, hereinafter a direction from the top of image-forming apparatus 1 to stacker 40 is defined as a down direction, and a direction from stacker 40 to each of scanning exposure device 10 and developing device 20 is defined as an up direction.

Scanning exposure device 10 includes housing 11 and cover 12. Scanning exposure device 10 is located between developing device 20 and stacker 40. Scanning exposure device 10 includes a member for leading a light, and emits a light to photosensitive drums 22. Scanning exposure device 10 uses a reflecting member described below, and reflects and leads a light. Housing 11 is formed of a material such as plastic, and houses the member for leading a light and the reflecting member. Housing 11 has aperture 13 opening in a direction in which a light is emitted. Cover 12 is formed of a material such as plastic, and closes aperture 13.

Photosensitive drums 22 are exposed by scanning exposure device 10, and latent images are formed on their surfaces. Developing device 20 provides toner to photosensitive drums 22, develops latent images and forms toner images on the surfaces of photosensitive drums 22. Toner images formed on photosensitive drums 22 are transferred onto intermediate transfer belt 31, which is disposed to contact photosensitive drums 22. Secondary transfer roller 32 and back up roller 33 transfer a toner image transferred from photosensitive drums 22 to intermediate transfer belt 31, onto recording medium 2 transported by transporting unit 50. Recording medium 2 onto which an image is transferred is transported to fixing unit 60 by transporting unit 50.

Fixing unit 60 includes a heat source such as a halogen lamp, and fixes a toner image transferred onto recording medium 2. Recording medium 2 on which an image is fixed is outputted to the outside of image-forming apparatus 1 by output roller 51 of transporting unit 50. In this manner, image-forming apparatus 1 forms an image on recording medium 2. Stacker 40 includes feed roller 41, and stores recording medium 2. Stacker 40 feeds stored recording medium 2 to transporting unit 50. Transporting unit 50 includes plural rollers, and transports recording medium 2. Recording medium 2 is an example of a recording medium according to the present invention. It is to be noted that a recording medium according to the present invention is not limited to a medium formed of a paper, but may be a medium formed of a plastic.

Figure 2:
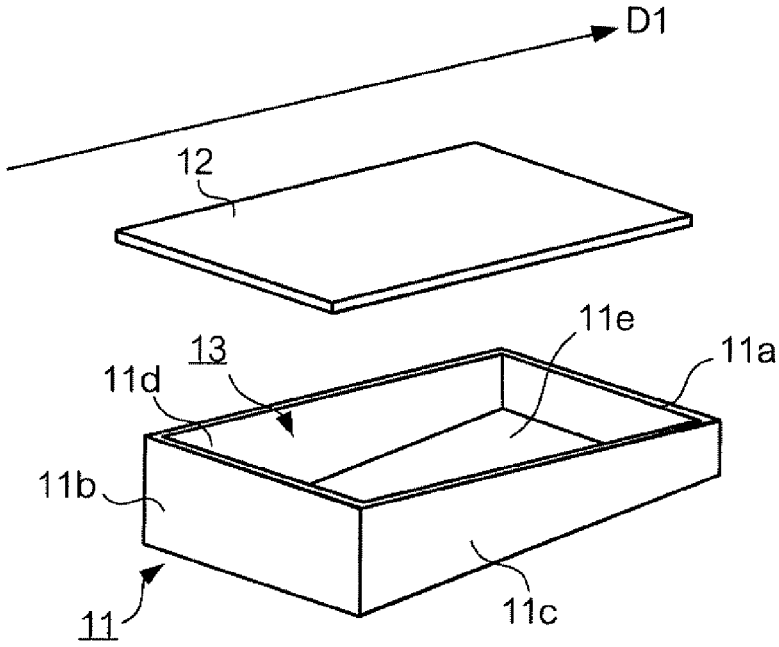
FIG. 2 is a schematic diagram of a housing of a scanning exposure device.

FIG. 2 is a schematic diagram of housing 11 of scanning exposure device 10. In FIG. 2 arrow D1 indicates a direction from developing unit 21Y to developing unit 21K along a row of aligned developing units 21Y, 21M, 21C, and 20K, which are provided at the upper part of scanning exposure device 10. For convenience of explanation, a direction indicated by arrow D1 is defined as a front direction, and the direction opposite to the front direction is defined as a back direction. Housing 11 includes front wall 11*a*, rear wall 11*b*, right sidewall 11*c*, and left sidewall 11*d*, which form aperture 13. Front wall ll*a* and rear wall 11*b*are located at the front and the back of aperture 13, respectively. Right sidewall 11*c* and left sidewall 11*d* are located to face each other. In the exemplary embodiment, one of right sidewall 11*c* and left sidewall ll*d* corresponds to "a first side wall" according to the present invention, and the other corresponds to "a second side wall" according to the present invention.

Ends of right sidewall 11*c* and left sidewall 11*d* contact ends of front wall 11*a* and rear wall 11*b*. Housing 11 includes bottom 11*e* on an opposite side of aperture 13. Bottom 11*e* contacts ends of front wall 11*a*, rear wall 11*b*, right sidewall 11*c*, and left sidewall 11*d*, which ends are located at the opposite side to aperture 13. Right sidewall 11*c* and left sidewall 11*d* are located on a right side and a left side, respectively, as viewed in a direction from aperture 13 to bottom 11*e* while front wall 11*a* is positioned at the head. For convenience of explanation, hereinafter each length of right sidewall 11*c* and left sidewall 11*d* in a direction from bottom 11*e* to aperture 13 is referred to as "height." A greater height is described as high, and a smaller height is described as low. Right sidewall 11*e* and left sidewall 11*d* are formed such that heights by rear wall 11*b* are higher than heights by front wall 11*a*. In other words, heights of right sidewall 11*c* and left sidewall 11*d* by front wall 11*a* are lower than those heights by rear wall 11*b*.

Figure 3:
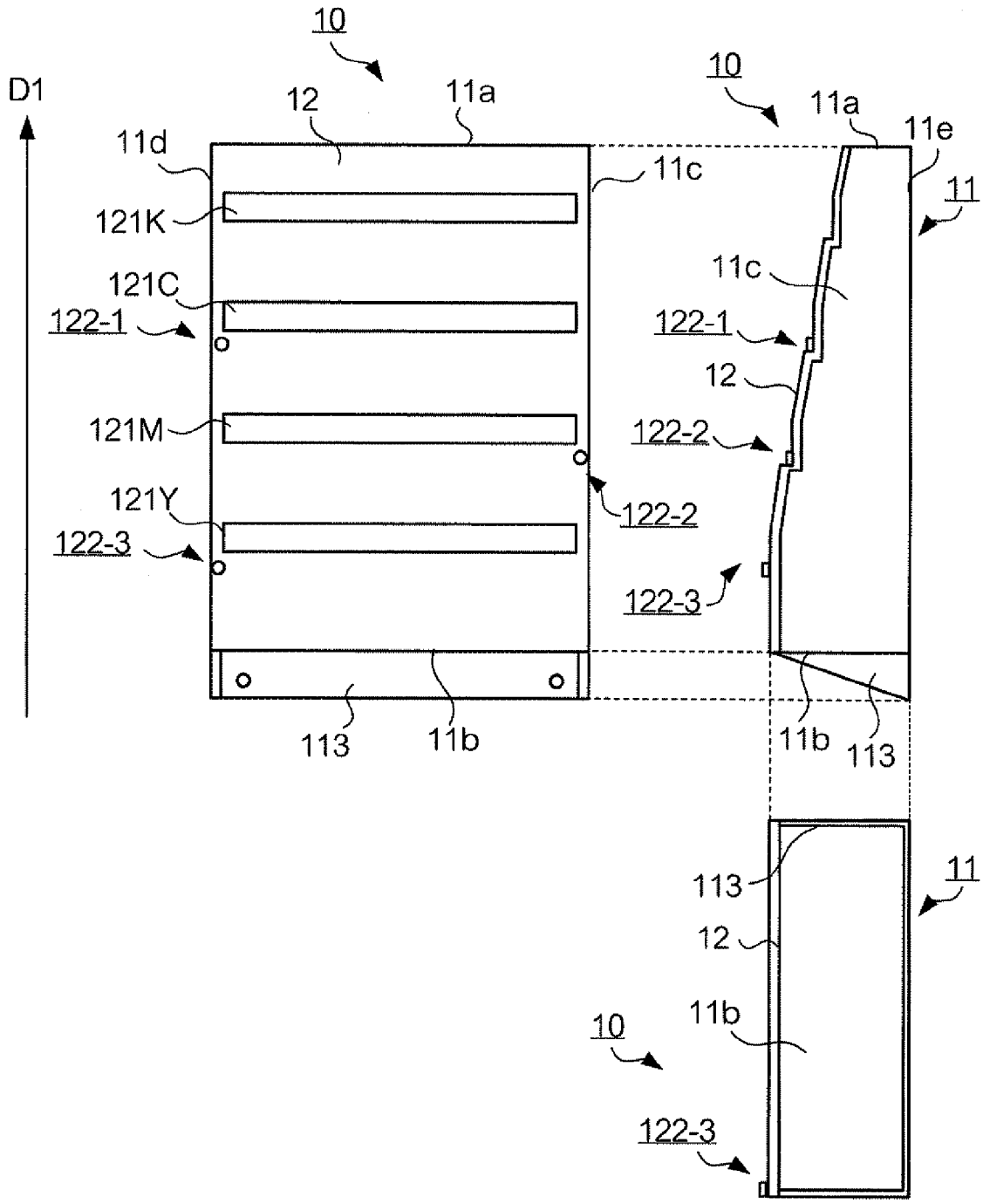
FIG. 3 is an orthographic view of a scanning exposure device.

FIG. 3 is an orthographic view of scanning exposure device 10. Cover 12 has passing portions 121Y, 121M, 121C, and 121K (each of which is referred to hereinafter as passing portion 121 when no distinction need be made between these passing portions). Passing portions 121 allow passage of a light emitted from the inside of scanning exposure device 10 described below. Each of passing portions 121 may have a structure in which a transparent member such as a member made of plastic is fitted, or may be a mere aperture portion without any member to prevent light from passing through. Connection portion 113 is formed of a material such as plastic, and is fixed to rear wall 11*b*. Connection portion 113 is connected to image-forming apparatus 1 by a fastener such as a screw and a bolt.

Fixed positions 122-1, 122-2, and 122-3 (each of which is referred to hereinafter as fixed position 122 when no distinction need be made between these fixed positions) are holes. Housing 11 and cover 12 are fixed at fixed positions 122-1, 122-2, and 122-3 by fasteners that include screws such as bolts and nuts, or set screws not shown. Fixed position 122-1 and fixed position 122-3 are located by left sidewall 11*d* on cover 12. Fixed position 122-2 is located by right sidewall 11*c* on cover 12. Fixed position 122-1 and fixed position 122-2 are located such that passing portion 121M is located between these fixed portions, when scanning exposure device 10 is viewed from above. Fixed position 122-3 and fixed position 122-2 are located such that passing portion 121Y is located between these fixed portions, when scanning exposure device 10 is viewed from above. Those two fixed positions, which are located by left sidewall 11*d* and right sidewall 11*c*, respectively, and have a particular positional relationship, are referred to as "paired fixed positions." In the exemplary embodiment, fixed position 122-1 and fixed position 122-2 may become paired, or alternatively fixed position 122-3 and fixed position 122-2 may become paired. However one of fixed position 122-1 and fixed position 122-3 does not become paired with fixed position 122-2. One of paired fixed positions corresponds to "a first fixed position" according to the present invention, and the other corresponds to "a second fixed position" according to the present invention. It is to be noted that housing 11 and cover 12 may be fixed at fixed position 122 by a pair of parts such as a snap fit, one part of such pair being formed respectively on each of housing 11 and cover 12 such as to be fitted to each other.

Figure 4:
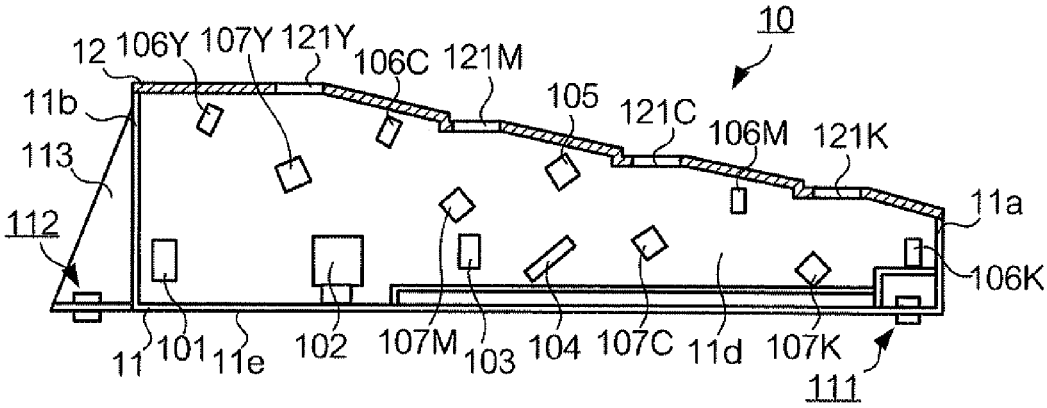
FIG. 4 is a diagram of an internal configuration of a scanning exposure device.

FIG. 4 is a diagram of an internal configuration of a scanning exposure device. Irradiating unit 101 includes a light source for irradiating a light corresponding to Y, M, C, and K colors, and irradiates a light to rotary polygon mirror 102 on the basis of an image to be formed. In the exemplary embodiment, the light source of irradiating unit 101 irradiates a laser light. Rotary polygon mirror 102 has plural reflecting surfaces for reflecting a light, and reflects incident light to fθ lens 103 while being rotated by drive means such as a motor, not shown. fθ lens 103 has a distortion characteristic to correct focal length f based on angle of incidence θ. A laser light reflected by rotary polygon mirror 102 moves at a constant angular velocity. fθ lens 103 has a function to correct a laser light such that the laser light irradiates the surface of photosensitive drum 22 at a constant velocity. A reflected laser is incident on reflecting member 104 via fθ lens 103. Reflecting member 104 has a reflector such as a mirror, and reflects an incidence laser light.

It is to be noted that irradiating unit 101 may be provided at the outside of scanning exposure device 10. In this case, housing 11 includes a member to allow passage of a light reflected by rotary polygon mirror 102.

A reflected light is reflected by reflecting member 105, any of reflecting members 106Y, 106M, 106C or 106K (each of which is referred to hereinafter as "reflecting member 106" when no distinction need be made between these reflecting members), and any of reflecting members 107Y, 107M, 107C or 107K (each of which is referred to hereinafter as "reflecting member 107" when no distinction need be made between these reflecting members), and is read to any of passing portions 121. For example, a laser light corresponding to Y is reflected to reflecting member 106Y by reflecting member 105. Reflecting member 106Y reflects the laser light to reflecting member 107Y. Reflecting member 107Y reflects the laser light to passing portion 121Y. The laser light passes through passing portion 121Y, and irradiates photosensitive drum 22Y of developing device 20Y. Other laser lights of M, C and K colors are reflected to corresponding reflecting members 106 by reflecting member 105. Then the laser lights are reflected by corresponding reflecting members 107, and are incident on corresponding passing portions 121.

Connection portions 111 and 112 are positions where a body of image-forming apparatus 1 and scanning exposure device 10 are connected by a fastener such as a screw and a bolt. Connection portion 111 is located by front wall 11*a* on bottom 11*e*. Connection portion 112 is located by connection portion 113 on bottom 11*e*. It is to be noted that connection portion 112 may be located by rear wall 11*b* on bottom 11*e*.

Figure 5:
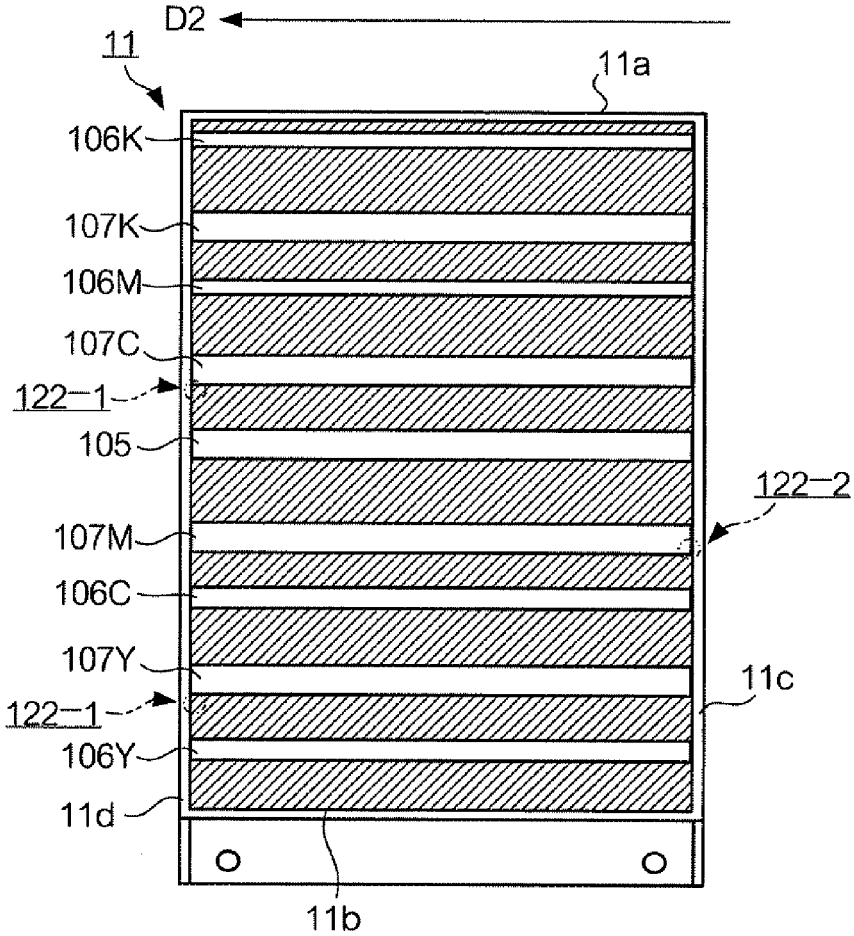
FIG. 5 is a diagram of reflecting members.

FIG. 5 is a diagram showing reflecting members. FIG. 5 shows reflecting member 105, reflecting members 106 and reflecting members 107, when scanning exposure device 10 is viewed from above. Alternately long- and double short-dashed lines of FIG. 5 indicate fixed positions 122. In addition, in FIG. 5 bottom 11*e* is indicated by hatching in order to distinguish it from reflecting member 105, reflecting members 106 and reflecting members 107. Reflecting member 105, reflecting members 106 and reflecting members 107 have reflectors such as mirrors. Reflecting member 105, reflecting members 106 and reflecting members 107 are supported such that those ends are movable toward right sidewall 11*c* and left sidewall 11*d* within a predetermined range. Reflecting members 105, 106, and 107 adjust paths of laser lights by changing both a position where the ends are fixed and an angle of the reflector. Reflecting members 105, 106, and 107, right sidewall 11*c* and left sidewall 11*d* have a mechanism for adjusting a position. In the exemplary embodiment, one end fixed to right sidewall 11*e* or left sidewall 11*d* corresponds "a first end" according to the present invention, and another end corresponds to "a second end" according to the present invention. A laser light irradiated from irradiating unit 101 is reflected by rotary polygon mirror 102 and fθ lens 103 at a constant speed in a direction from right sidewall 11*c* to left sidewall 11*d* (or in the opposite direction).

Reflecting members 105, 106, and 107 have widths enabling them to reflect a laser light moving in a direction to right and left. Reflecting members 107 reflect a laser light to aperture 13. Laser lights reflected by reflecting members 107 pass through passing portions 121, and irradiate photosensitive drums 22. Photosensitive drums 22 are arranged along reflecting members 107. An operation, in which laser lights based on image data to be formed irradiate photosensitive drums 22 while moving, is referred to as "scanning." In addition, a direction of scanning by a laser light is referred to as a main scanning direction. In the exemplary embodiment, scanning is performed in main scanning direction D2 from right sidewall 11*c* to left sidewall 11*d*. Reflecting members 105, 106, and 107 are located such that the longitudinal direction of the members is along main scanning direction D2.

If housing 11 is deformed, a force is applied to reflecting members 105, 106 and 107 at the ends thereof that are respectively fixed to right sidewall 11*c* and left sidewall 11*d*. Reflecting members 105, 106, and 107 have distortion such as deflection and twist on the basis of a direction of the applied force. When distortion occurs, reflecting members 105, 106, and 107 change paths of laser lights. If scanning is performed by a laser light moving along the changed path, a position where an image is developed is shifted.

Figure 6:
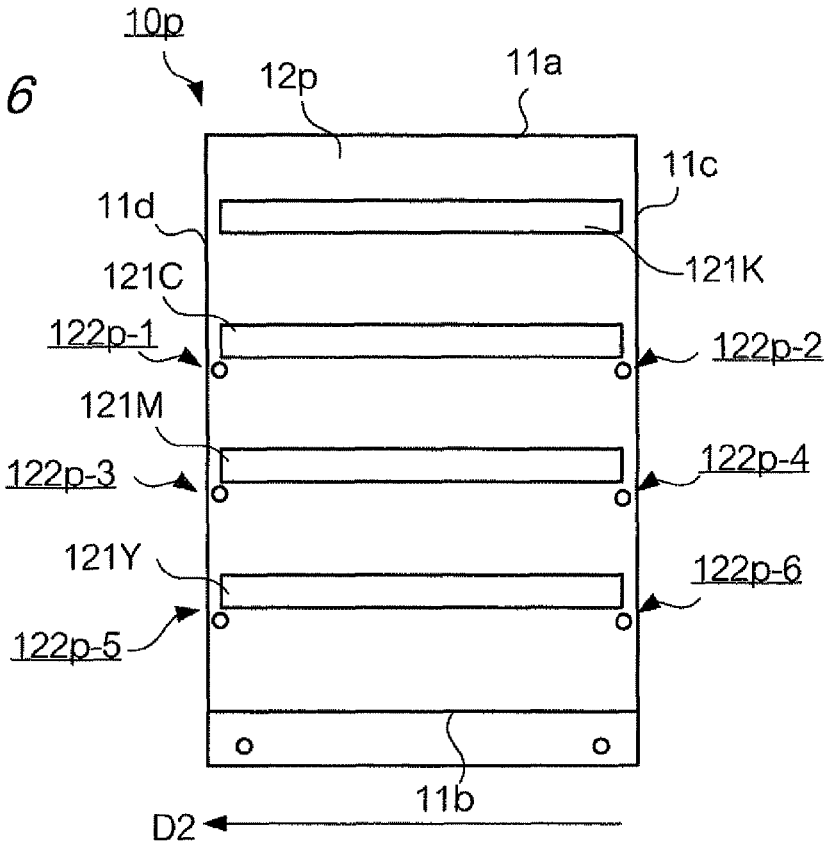
FIG. 6 is a diagram of another scanning exposure device shown for comparison with a scanning exposure device.

FIG. 6 is a diagram of another scanning exposure device 10*p* shown for comparison with scanning exposure device 10. Scanning exposure device 10*p* has a common configuration with scanning exposure device 10, other than fixed positions. On cover 12*p* of scanning exposure device 10*p*, six fixed positions 122*p*-1, 122*p*-2, 122*p*-3, 122*p*-4, 122*p*-5 and 122*p*-6 are provided. Fixed positions 122*p*-1 and fixed position 122*p*-2 are arranged such that a straight line connecting these fixed positions is parallel to main scanning direction D2. Hereinafter this relationship of paired fixed positions is referred to as a "parallel" relationship. Fixed position 122*p*-3 and fixed position 122*p*-4, and fixed positions 122*p*-5 and fixed position 122*p*-6 have parallel relationships.

Figure 7A:
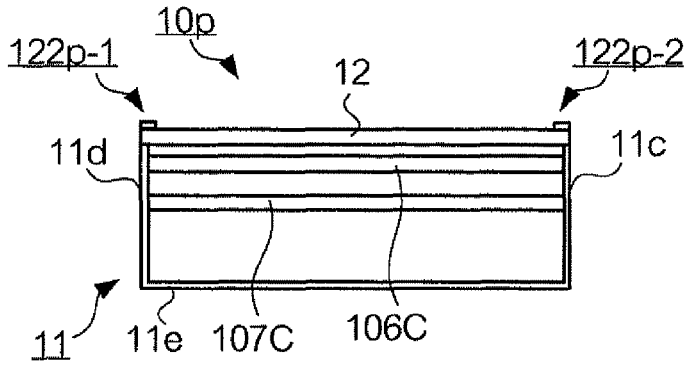
FIGS. 7A and 7B are diagrams describing an aspect of a deformation of a scanning exposure device.
Figure 7B:
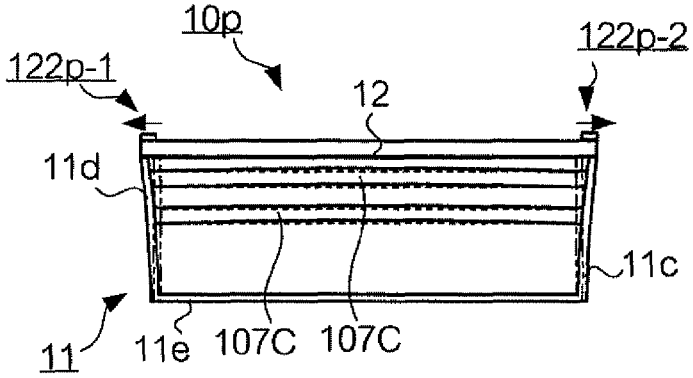

FIGS. 7A and 7B are diagrams describing a deformation of scanning exposure device 10*p*. FIGS. 7A and 7B show the inside of scanning exposure device 10*p* from the front. In FIGS. 7A and 7B, only reflecting members 106C and 107C are shown as internal members. Fixed position 122*p*-1 and 122*p*-2 are located by left sidewall 11*d* and right sidewall 11*c* on cover 12*p*, respectively. Cover 12 and housing 11 are fixed by fasteners at fixed positions 122*p*-1 and 112*p*-2. Cover 12 and housing 11 of scanning exposure device 10*p* are formed of materials having different compositions. When cover 12 and housing 11 have different compositions, cover 12 and housing 11 have different coefficients of linear expansion. For example, it is assumed that cover 12 is formed a material having a coefficient of linear expansion greater than that of housing 11. In this case, linearly expanded cover 12*p* applies to ends of right sidewall 11*c* and left sidewall 11*d* a force toward the outside of housing 11.

On the other hand, housing 11 applies to cover 12*p* a force in the opposite direction of the force applied by cover 12*p*. These forces are action-reaction forces that cover 12 and housing 11 exert against each other along main scanning direction D2 at fixed positions 122*p*. Fixed position 122*p*-1 and fixed position 122*p*-2 are paired fixed positions arranged to have parallel relationships. Therefore, a reaction force from housing 11 acts on cover 12 at fixed position 122*p* in a direction in which cover 12 is compressed. At this time, deformation conditions of cover 12*p* and housing 11 are determined by each modulus of elasticity of cover 12*p* and housing 11. For example, it is assumed that housing 11 of scanning exposure device 10*p* is formed such that rigidity in the main scanning direction is smaller than a bulk modulus of cover 12*p*. In this case, housing 11 is deformed toward the outside of housing 11 due to a force applied by cover 12*p*.

FIG. 7A is a diagram of cover 12*p* prior linearly expanded. FIG. 7B is a diagram of housing 11 having deflection due to linear expansion of cover 12*p*. Right sidewall 11*c* and left sidewall 11*d* of deflected housing 11 apply a force to ends of reflecting members 106C and 107C such that each center part of reflecting members 106C and 107C becomes convex toward cover 12*p* (upward). The force causes reflecting members 106C and 107C to curve such that those center parts become convex toward cover 12*p*. A laser light is reflected on an upper half surface of reflecting member 107C, and moves to passing portion 121C. In other words, a laser light is reflected on a convex surface, whereby a width from a start position to an end position of scanning is expanded. Hereinafter this width is referred to as "scan width," and a length of the width is referred to as "variation of scan width." A variation of scan width is affected by ease of deformation of right sidewall 11*c* and left sidewall 11*d* at the ends located by cover 12*p*. Specifically, a variation of scan width is affected by a flexural rigidity and twist rigidity (hereinafter referred to as "rigidity") when a force is applied to the ends in main scanning direction D2.

Turning now to FIG. 4, left sidewall 11*d* of scanning exposure device 10*p* has a configuration shown in FIG. 4. Left sidewall 11*d* is supported by front wall 11*a* and rear wall 11*b* against a force applied in main scanning direction D2. Therefore a part closer to front wall 11*a* or rear wall 11*b* on left sidewall 11*d* is supported greatly against the force. In other words, the rigidity of left sidewall 11*d* is greater at a closer distance from front wall 11*a* or rear wall 11*b*. In addition, rigidity of left sidewall 11*d* is greater where its height is lower. As described above, left sidewall 11*d* is higher at a side by front wall 11*a* and becomes lower toward a side by rear wall 11*b*. Therefore, rigidity of left sidewall 11*d* at an end located by cover 12*p* in a part surrounding passing portion 121M is smaller than that of other parts.

A level of linear expansion of cover 12*p* is also changed by an amount of heat applied to cover 12*p*. Scanning exposure device 10 contains components that generate heat. For example, irradiating unit 101 generates heat while it converts electrical energy to light. Rotary polygon mirror 102 generates heat by driving of a drive unit. Particularly, rotary polygon mirror 102 generates the greatest amount of heat. Thus, cover 12*p* is subjected a greater amount of heat at a part between passing portion 121M and passing portion 121Y, which part is located at an upper part of rotary polygon mirror 102 in a vertical direction, compared with other parts. Irradiating unit 101 and rotary polygon mirror 102 each correspond to a heat-generating unit according to the present invention.

Figure 8:
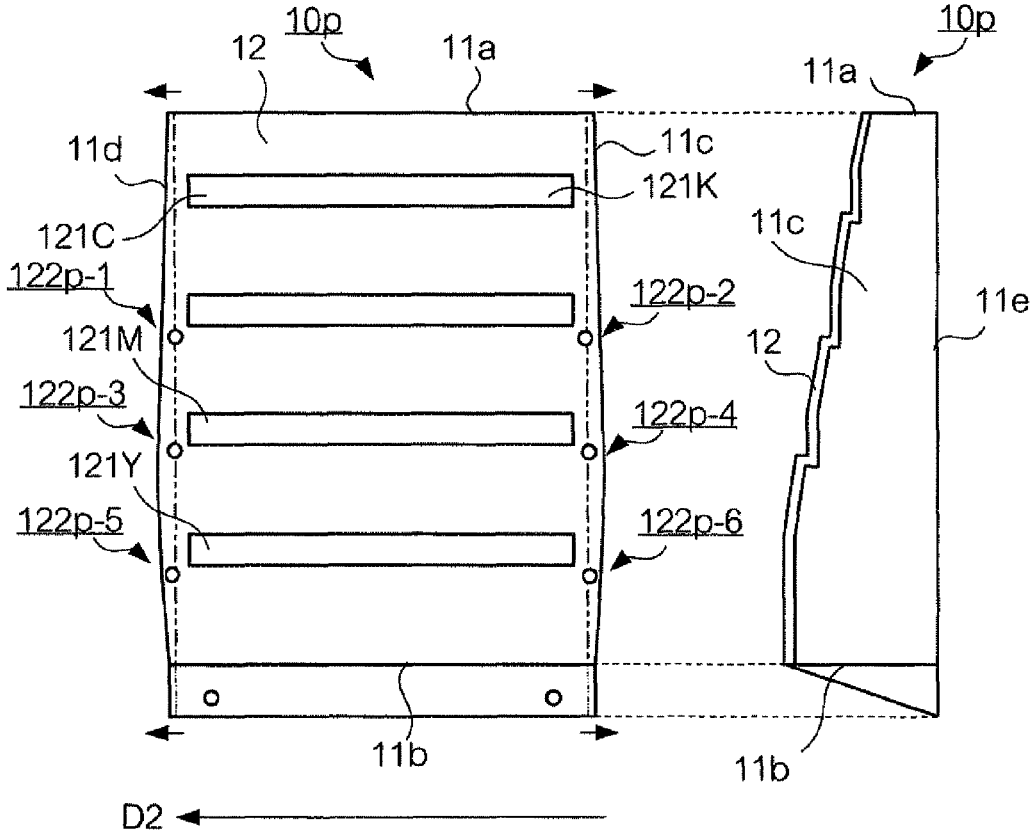
FIG. 8 is a diagram of a linearly expanded cover having six fixed positions.

FIG. 8 is a diagram of linearly expanded cover 12*p* of scanning exposure device 10*p*. As described above, housing 11 and cover 12*p* exert action-reaction forces against each other along main scanning direction D2 at fixed positions 122*p*. A pair of fixed position 122*p*-1 and fixed position 122*p*-2, a pair of fixed position 122*p*-2 and fixed position 122*p*-4, and a pair of fixed position 122*p*-5 and fixed position 122*p*-6 are arranged such that each pair has a parallel relationship. Therefore, a reaction force from housing 11 acts on cover 12 at fixed positions 122*p* in a direction in which cover 12 is compressed. It is also assumed that housing 11 is formed such that rigidity against the main scanning direction is smaller than a bulk modulus of cover 12*p*. In this case, housing 11 is deformed toward the outside of housing 11 at paired fixed positions having parallel relationships due to a force applied by cover 12*p*.

As described above, rigidity of right sidewall 11*c* and left sidewall 11*d* at ends located by cover 12*p* is the smallest in a surround of passing portion 121M or a surround of a part between passing portion 121M and passing portion 121Y. In addition, a part between passing portion 121M and passing portion 121Y on cover 12*p* is subjected to a greater amount of heat generated by rotary polygon mirror 102. Therefore, an amount of expansion of right sidewall 11*c* and left sidewall 11*d* due to linear expansion increases in a part between passing portion 121M and passing portion 121Y on cover 12*p*. Due to those effects, in scanning exposure device 10*p*, a part between passing portion 121M and passing portion 121Y is deformed more than other fixed portions. An amount of deformation decreases as a position on cover 12*p* is closer to front wall 11*a* or rear wall 11*b*. Next description is given of an experimental result of measurement of scan width variations of laser lights corresponding to Y, M, C, and K colors in scanning exposure device 10*p*.

Figure 9:
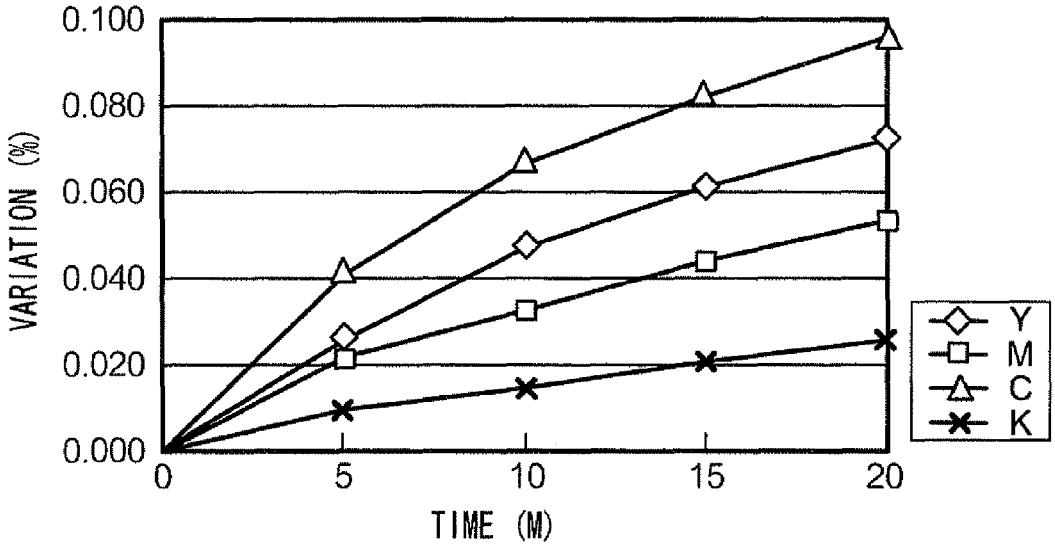
FIG. 9 is a graph indicating time variations of scan width variations in a scanning exposure device.

FIG. 9 is a graph indicating time variations of scan width variations in scanning exposure device 10*p*. As shown in this graph, a laser light passing through passing portion 121C had a scan width variation greater than that of each laser light passing through other passing portions 121. A laser light passing through light passing portion 121K had a scan width variation smaller than that of each laser light passing through other passing portions 121. Next description is given for fixed positions on cover 12 and scan width variations of scanning exposure device 10 according to the exemplary embodiment.

Figure 10:
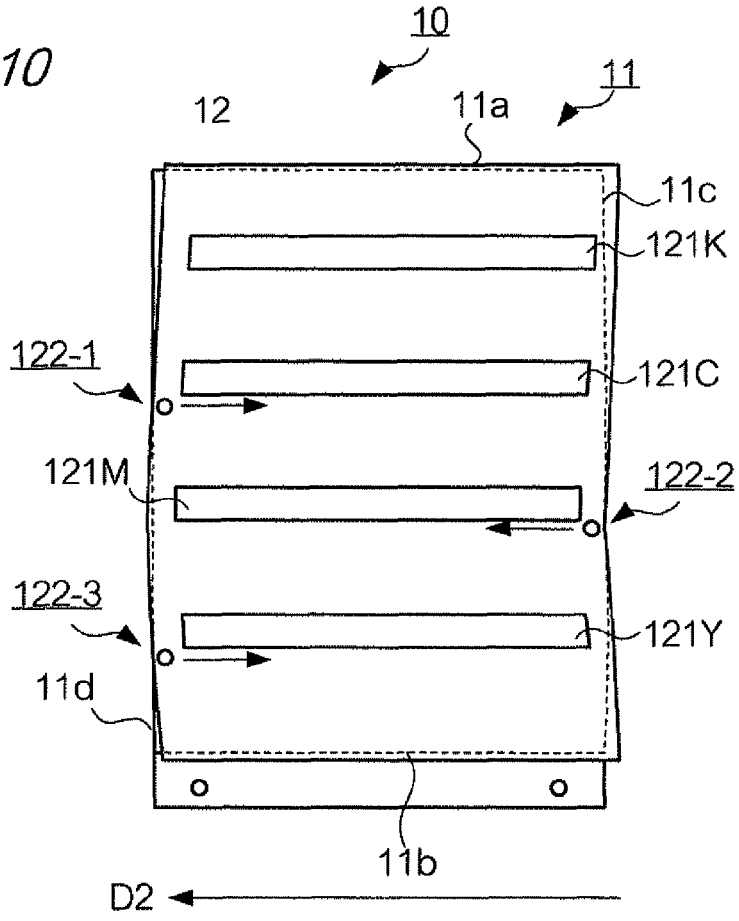
FIG. 10 is a diagram of a linearly expanded cover of a scanning exposure device according to the exemplary embodiment.

FIG. 10 is a diagram of linearly expanded cover 12 of scanning exposure device 10 according to the exemplary embodiment. A dotted line of FIG. 10 indicates the outer edge of housing 11. Paired fixed positions 122 in scanning exposure device 10 are arranged such that a straight line connecting the fixed positions crosses main scanning direction D2. In other words, paired fixed positions 122 in scanning exposure device 10 are arranged such that main scanning direction D2 passes between them. In addition, paired fixed positions 122 are arranged such that passing portion 121 is located between the fixed positions. As described above, housing 11 and linearly expanded cover 12 exert action-reaction forces against each other along main scanning direction D2 at fixed positions 122. Therefore, a reaction force acts on fixed positions 122 in a direction in which cover 12 is bent, which direction is indicated by the arrow of FIG. 10. At this time, deformation of cover 12 and housing 11 are determined by the modulus of elasticity each of cover 12 and housing 11. For example, it is assumed that cover 12 is formed such that rigidity in fixed positions 122 against the main scanning direction is smaller than that of housing 11. In this case, cover 12 is deformed due to a force applied by housing 11. It is to be noted that rigidity of parts surrounding ends of passing portions 121 that are formed of planes having small widths is small against a force in a main scanning direction. The parts surrounding ends of passing portions 121 are highly deformed when cover 12 is deformed. Next, description is given for an experimental result of measurement of scan width variations in scanning exposure device 10.

Figure 11:
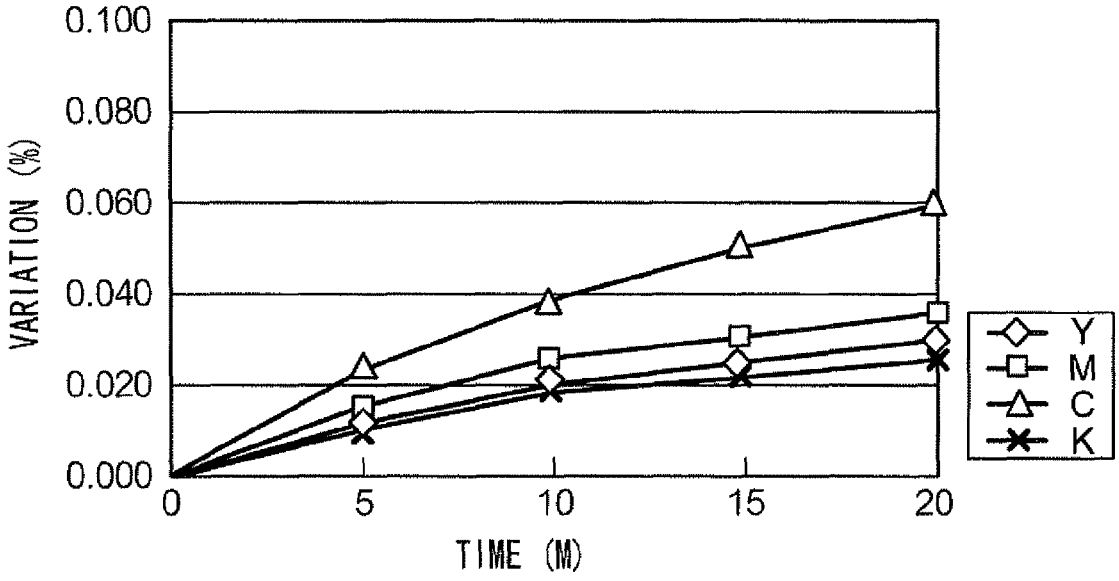
FIG. 11 is a graph indicating time variations of scan width variations in a scanning exposure device.

FIG. 11 is a graph indicating time variations of scan width variations in scanning exposure device 10. As compared to scan width variations in scanning exposure device 10*p* shown in FIG. 9, scan width variations of laser lights of Y, C and M colors after 20 minutes became small. In particular, a scan width variation of a laser light of color C after 20 minutes became the smallest among scan width variations of laser lights of the colors. In contrast, a scan width variation of a laser light of color K after 20 minutes was almost the same as that shown in FIG. 9, since a reflecting member for reflecting the laser light is fixed to a low sidewall, and the reflecting member is far from parts generating heat. In addition a difference between a maximum value and a minimum value of each scan width variation for the colors in scanning exposure device 10 became smaller than that of scanning exposure device 10*p*. If the difference is small, a gap between images of the colors decreases particularly on both sides in a main scanning direction when the images are overlapped.

As described above, cover 12 of scanning exposure device 10 prevents distortion of housing 11 due to a force of linear expansion of cover 12. In addition, cover 12 serves to maintain rigidity of housing 11 when another force is applied to housing 11. In this case, when a force by which housing 11 will be deformed is transmitted to cover 12 via fixed positions 122, cover 12 receives a force using an elastic force thereof, whereby deformation of housing 11 is prevented. In this manner, cover 12 prevents housing 11 being distorted due to a force applied from the outside if rigidity of housing 11 does not increase.

The foregoing is a description of an exemplary embodiment of the present invention; however the present invention can be practiced in various aspects as described below.

In the above exemplary embodiment, three fixed positions are provided, but another number of fixed positions, for example, two or four fixed positions may be provided. In a case where three fixed positions are provided, the fixed positions may be provided at positions different from the positions in the exemplary embodiment. In this case, each fixed position may be determined based on at least one of a position of a heat-generating unit, a position where reflecting members for reflecting a laser light are fixed, a distance to the fixed position from front wall 11*a* or rear wall 11*b*, and a height of the fixed position from bottom 11*e*.

Figure 12A:
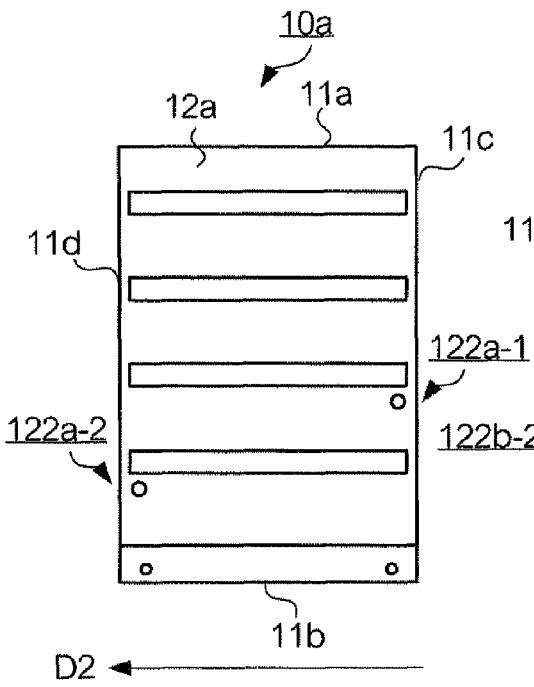
FIGS. 12A to 12D are diagrams of a scanning exposure device according to a modification.
Figure 12B:
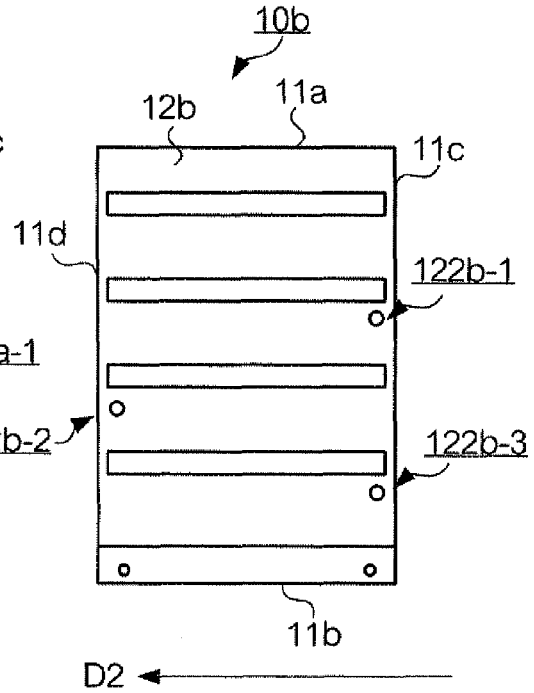

FIGS. 12A to 12D are diagrams of scanning exposure devices according to a modification. Scanning exposure devices 10*a*, 10*b*, 10*c* and 10*d* have common configurations with scanning exposure device 10 other than fixed positions. FIG. 12A is a diagram of scanning exposure device 10*a* having two fixed positions. In this case, fixed positions 122*a*-1 and 122*a*-2 on cover 12*a* may be located at other positions if the positions are arranged such that a direction of a straight line connecting the fixed positions crosses a main scanning direction. FIG. 12B is a diagram of scanning exposure device 10*b* having three fixed positions. An arrangement of fixed positions 122*b*-1, 122*b*-2 and 122*b*-3 is different from that of fixed positions 122 of scanning exposure device 10. In this case, when the fixed positions are actually changed, the variations may be changed if a number of the fixed positions are identical, because both a distance between a fixed position and a heat-generating unit and the height vary when the fixed positions are changed.

Figure 12C:
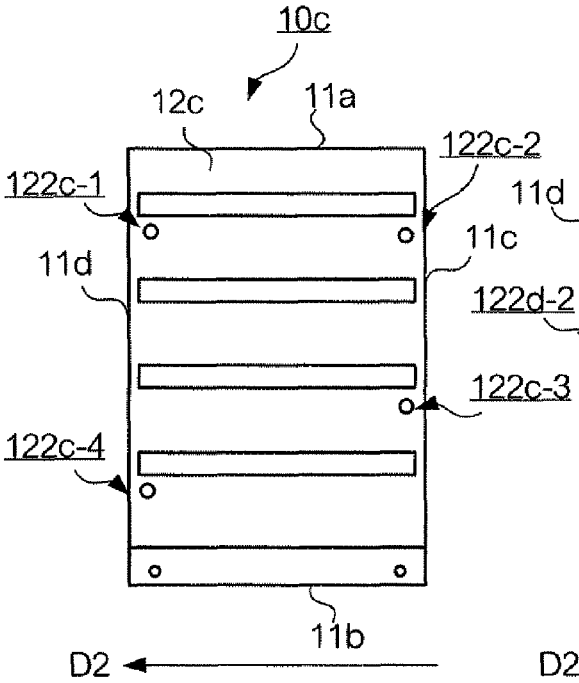
Figure 12D:
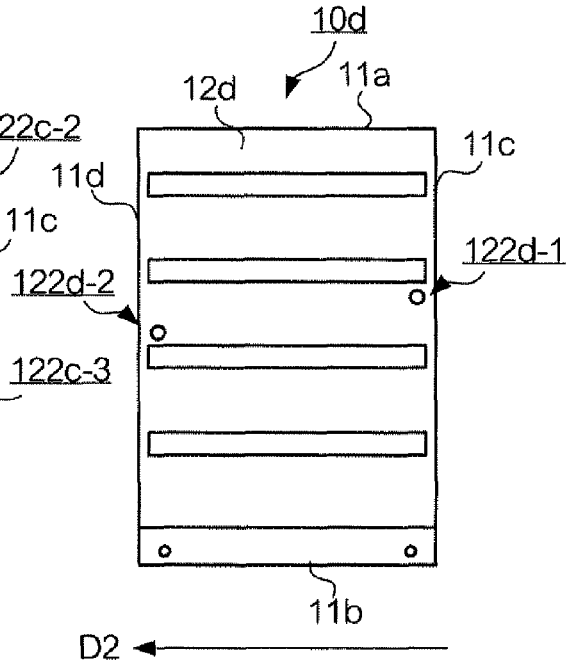

FIG. 12C is a diagram of scanning exposure device 10*c* having four fixed positions. On cover 12*c*, a pair of fixed positions 122*c*-3 and 122*c*-4, and a pair of fixed positions 122*e*-1 and 122*c*-2 are provided. A straight line connecting fixed positions 122*c*-3 and 122*c*-4 crosses main scanning direction D2. A straight line connecting fixed positions 122*c*-1 and 122*c*-2 is parallel to main scanning direction D2. As shown in FIG. 12C, if at least one pair of fixed positions having a relationship that a straight line connecting the positions crosses main scanning direction D2 is provided, another pair of fixed positions having a parallel relationship may be provided. FIG. 12D is a diagram of scanning exposure device 10*d* having two fixed positions. As shown in FIG. 12D, a pair of fixed positions having a relationship that a straight line connecting the positions crosses main scanning direction D2 may be located other than on both sides of passing portion 121.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiments have been chosen and described to best explain the principles of the invention and its practical applications, thereby enabling others skilled in the art to understand the invention for use with various embodiments and with various modifications as suited to a particular use contemplated. It is intended that the scope of the invention be defined by the following claims and their equivalents.

What is claimed is:

1. A scanning exposure device comprising:

a reflecting member that has a width extending from a first end to a second end in a main scanning direction, to reflect a light irradiated by an irradiating unit;

a housing that has a bottom, a first sidewall to which the first end is fixed, a second sidewall facing the first sidewall, to which the second end is fixed, and an aperture provided in an opposing relation to the bottom, the aperture opening in a direction of a light reflected by the reflecting member; and a cover that covers the aperture, the cover forming a passing portion that allows the light reflected by the reflecting member to pass through, and providing a first fixed position at which the cover is fixed on the first sidewall at a top surface of the first sidewall and a second fixed position, paired with the first fixed position, at which the cover is fixed on the second sidewall at a top surface of the second sidewall, wherein each pairing of every position at which the cover is fixed on the first sidewall and every position at which the cover is fixed on the second sidewall is arranged so as to form a line extending in a direction offset from the main scanning direction, and wherein a height from the first fixed position to the bottom is different from a height from the second fixed position to the bottom.

2. The scanning exposure device according to claim 1, wherein the passing portion is located between the first fixed position and the second fixed position.

3. The scanning exposure device according to claim 2, wherein pairing of the first fixed position and the second fixed position is determined on the basis of at least one of a position of a heat-generating unit that generates heat, positions of the first end and the second end, a position of a third sidewall that supports the first side and the second side, and a height of the first sidewall or the second sidewall from the bottom to the aperture.

4. The scanning exposure device according to claim 2, wherein the housing and the cover are fixed at the first fixed position and the second fixed position by fasteners.

5. The scanning exposure device according to claim 2, wherein the first end of the reflecting member is movably supported by the first sidewall within a predetermined range, and the second end of the reflecting member is movably supported by the second sidewall within a predetermined range.

6. The scanning exposure device according to claim 2, wherein the cover and the housing are formed of materials having different coefficients of linear expansion.

7. The scanning exposure device according to claim 1, wherein pairing of the first fixed position and the second fixed position is determined on the basis of at least one of a position of a heat-generating unit that generates heat, positions of the first end and the second end, a position of a third sidewall that supports the first side and the second side, and a height of the first sidewall or the second sidewall from the bottom to the aperture.

8. The scanning exposure device according to claim 7, wherein the housing and the cover are fixed at the first fixed position and the second fixed position by fasteners.

9. The scanning exposure device according to claim 7, wherein the first end of the reflecting member is movably supported by the first sidewall within a predetermined range, and the second end of the reflecting member is movably supported by the second sidewall within a predetermined range.

10. The scanning exposure device according to claim 7, wherein the cover and the housing are formed of materials having different coefficients of linear expansion.

11. The scanning exposure device according to claim 1, wherein the housing and the cover are fixed at the first fixed position and the second fixed position by fasteners.

12. The scanning exposure device according to claim 11, wherein the first end of the reflecting member is movably supported by the first sidewall within a predetermined range, and the second end of the reflecting member is movably supported by the second sidewall within a predetermined range.

13. The scanning exposure device according to claim 11, wherein the cover and the housing are formed of materials having different coefficients of linear expansion.

14. The scanning exposure device according to claim 1, wherein the first end of the reflecting member is movably supported by the first sidewall within a predetermined range, and the second end of the reflecting member is movably supported by the second sidewall within a predetermined range.

15. The scanning exposure device according to claim 14, wherein the cover and the housing are formed of materials having different coefficients of linear expansion.

16. The scanning exposure device according to claim 1, wherein the cover and the housing are formed of materials having different coefficients of linear expansion.

17. The scanning exposure device according to claim 1, further comprising at least one additional fixed position at which the cover is fixed on the first sidewall, such that a total number of fixed positions at which the cover is fixed on the first sidewall is greater than a total number of fixed positions at which the cover is fixed on the second sidewall.

18. An image-forming apparatus comprising:

a scanning exposure device that includes:

a reflecting member that has a width extending from a first end to a second end in a main scanning direction, to reflect a light irradiated by a irradiating unit;

a housing that has a bottom, a first sidewall to which the first end is fixed, a second sidewall facing the first sidewall, to which the second end is fixed, and an aperture provided in an opposing relation to the bottom, the aperture opening in a direction of a light reflected by the reflecting member; and a cover that covers the aperture, the cover forming a passing portion that allows the light reflected by the reflecting member to pass through, and providing a first fixed position at which the cover is fixed on the first sidewall at a top surface of the first sidewall and a second fixed position, paired with the first fixed position, at which the cover is fixed on the second sidewall at a top surface of the second sidewall; and an image-forming unit that forms an image on the basis of a light irradiated from the scanning exposure device, wherein each pairing of every position at which the cover is fixed on the first sidewall and every position at which the cover is fixed on the second sidewall is arranged so as to form a line extending in a direction offset from the main scanning direction, and wherein a height from the first fixed position to the bottom is different from a height from the second fixed position to the bottom.

19. The image-forming apparatus according to claim 18, the scanning exposure device further comprising at least one additional fixed position at which the cover is fixed on the first sidewall, such that a total number of fixed positions at which the cover is fixed on the first sidewall is greater than a total number of fixed positions at which the cover is fixed on the second sidewall.

* * * * *